United States Patent [19]

Terrones

[11] 4,217,676

[45] Aug. 19, 1980

[54] PLEAT FILLER AND DRAPERY HANGER COMBINATION

[76] Inventor: Thelma L. Terrones, P.O. Box 674, Pine Valley, Calif. 92062

[21] Appl. No.: 9,586

[22] Filed: Feb. 5, 1979

Related U.S. Application Data

[63] Continuation-in-part of Ser. No. 806,762, Jun. 15, 1977, abandoned.

[51] Int. Cl.[2] ..... E05D 13/02; A47H 13/04; A47H 15/00

[52] U.S. Cl. ..... 16/87.2; 16/93 D; 16/94 D; 16/95 D; 16/96 D; 24/73 CH; 24/81 DS; 160/348

[58] Field of Search ..... 24/73 CH, 81 DS, 84 R; 160/348; 16/87.2, 92, 93 D, 94 D, 95 D, 96 D

[56] References Cited

U.S. PATENT DOCUMENTS

| | | | |
|---|---|---|---|
| 2,544,516 | 3/1951 | Walters | 24/84 R |
| 2,602,205 | 7/1952 | Davis | 16/87.2 |
| 2,979,128 | 4/1961 | Murgolo | 160/348 |
| 3,037,556 | 6/1962 | Zuckerman et al. | 24/84 R |
| 3,261,065 | 7/1966 | Romano | 24/73 CH |
| 3,335,786 | 8/1967 | Weisberg | 24/84 R |
| 3,338,291 | 8/1967 | Kintner | 24/73 CH |
| 3,497,905 | 3/1970 | Pflum | 16/87.2 |
| 3,871,082 | 3/1975 | Pflum | 16/96 D |
| 3,881,217 | 5/1975 | Bytheway | 24/73 CH |

FOREIGN PATENT DOCUMENTS

| | | | |
|---|---|---|---|
| 1185835 | 3/1970 | United Kingdom | 16/87.2 |

*Primary Examiner*—Louis Rimrodt
*Attorney, Agent, or Firm*—Charles C. Logan, II

[57] ABSTRACT

This combination, consists primarily of cylindrical tubes that are inserted into drapery pleats, so as to retain the pleat shape indefinitely, and the drapery hanger device is of such structure that it will eliminate under-rod swing of drapery hooks. The structure of the tubes is of a material that will be non-collapsible, and are removable, in order that draperies may be cleaned. The drapery hanger device of the combination is of such structure, that it will project the bottom of the pleat outwards and is adjustable to the degree needed, depending on the weight of the drapery.

9 Claims, 5 Drawing Figures

PLEAT FILLER AND DRAPERY HANGER COMBINATION

This patent application is a continuation in part of patent application Ser. No. 806,762 filed on June 15, 1977 now abandoned.

This invention relates to drapery devices, and more particularly, to a pleat filler and drapery hanger combination.

It is, therefore the principal object to provide a pleat filler and drapery hanger combination, that will enable draperies to maintain their cylindrical pleats indefinitely.

Another object of this invention is to provide a pleat filler and drapery hanger combination that will enable the pleats to be uniform in appearance.

A further object of this invention is to provide a combination of the type described, which will enable the pleats not to be pinched at the top and will thus cause the pleats to be in true cylindrical form.

Other objects of the invention are to provide a pleat filler and drapery hanger combination, which is simple in design, inexpensive to manufacture, rugged in construction, easy to use and efficient in use.

These and other objects will be readily evident upon a study of the following specifications and the accompanying drawings, wherein.

Figure 1:
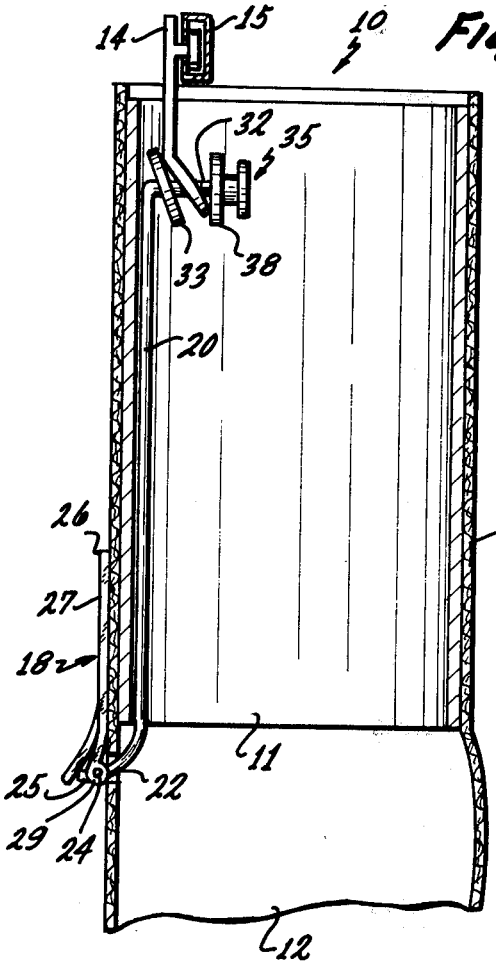
FIG. 1 is a cross sectional side elevation view illustrating the novel rod-like drapery hanger device in use.
Figure 2:
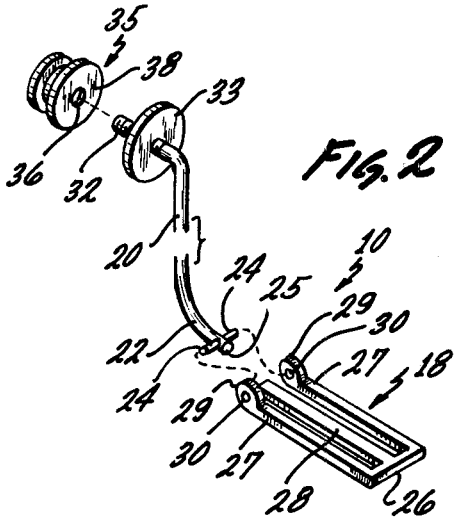
FIG. 2 is an exploded view of the novel drapery hanger device illustrated in FIG. 1.

The drapery hanger device will be described by referring to FIGS. 1 and 2. The drapery hanger device is generally designated numeral 10 and it is illustrated in use with drapery 12 having pleats 13. The drapery hanger device includes a cylindrical sleeve 11 made of a suitable and non collapsible material that is force fitted into the top of pleat 13. The top of the drapery hanger device is attached to a curtain rod lug 14 that is in turn supported from the curtain rod 15. Their would be a plurality of these curtain rod lugs and each of them would support one of the novel drapery hanger devices.

The drapery hanger device 10 is a generally u-shaped member having a pair of upwardly extending legs connected together at their bottoms by a cross member. One of these legs is the drapery attaching leg 18 and the other leg is the middle body leg 20. The cross member or connecting section between the bottom of the two legs is designated numeral 22. Extending laterally outwardly from cross member 22 are pin members 24. The drapery attaching leg 18 is formed from a cross member 26 having a plurality of spring fingers extending transversely therto. These are outer spring fingers 27 and middle spring finger 28. Formed at the ends of the spring fingers 27 are pin attachment lugs 29 having pin receiving apertures 30. Drapery leg 18 is made of a resilint material which allows the outer spring fingers 27 to be spread outwardly so that pins 24 can be captured within receiving apertures 30. When the drapery attaching leg 18 is in its drapery holding position, it will be seen that tip 25 of cross member 22 is forced against the free end of middle spring finger 28 to maintain tension upon the drapery.

At the top portion of the drapery hanger device is the curtain rod lug attaching member 32. It has a disc 33 on it that is spaced inwardly from its free end. The disc 33 functions as a shoulder against which one face of a curtain rod lug 14 is captured. The curtain rod lug attaching member 32 is also externally threaded on the disc 33 to its free end. A cap 35 having an internally threaded bore 36 is threaded on the free end of the curtain rod lug attaching member 32. Cap has a disc portion 38 that functions as a shoulder against which one face of the curtain rod 14 is captured. By screwing cap 35 onto the end of curtain rod lug attaching member 32 varying distances the angle which the drapery hanging device makes with a horizontal plane can be varied. Thus if the weight of the drapery is causing the top of the pleats to tilt outwardly, cap 35 can be tightened down further until the pleat is brought back to a vertical position.

Figure 3:
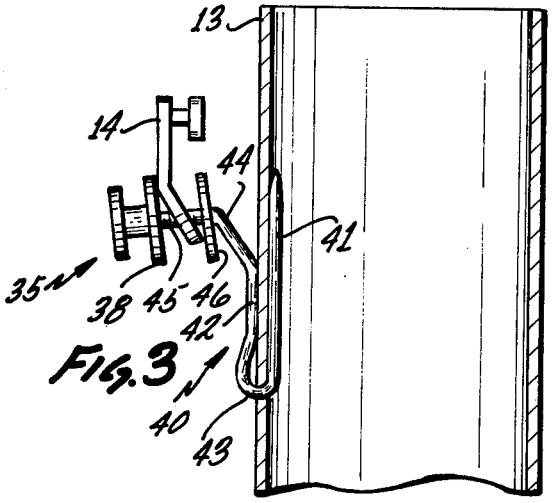
FIG. 3 is a cross-sectional elevation view illustrating a first alternative drapery hanger device.

A first alternative drapery hanger device is illustrated in FIG. 3 and it is generally designated numeral 40. It has a drapery attaching leg 41, a middle body leg 42, and a cross member 43 connecting the two at the bottom. Upper portion 44 of middle body leg 42 is bent inwardly at an acute angle away from the drapery attaching leg 41. Drapery hanger device 40 has a curtain rod lug attaching member 45 with a disc 46 spaced inwardly from its free end. Curtain rod lug attaching 45 is externally threaded and would receive a standard cap 35 such as previously described for adjusting the angle which the drapery hanging device would make with the curtain rod lug 14.

Figure 4:
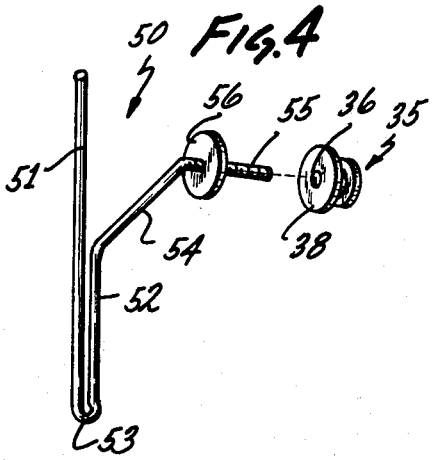
FIG. 4 is a perspective view illustrating a second alternative drapery hanger device.

A second alternative drapery hanger device 50 is illustrated in FIG. 4. It has a drapery attaching leg 51, a middle body leg 52 and they are both connected together at their bottoms by cross member 53. Upper portion 54 is bent inwardly at an acute angle away from drapery attaching leg 51. The curtain rod lug attaching member 55 is externally threaded and spaced inwardly from its free end is a disc 56. A standard cap 35 would be screwed on to the threaded portion of curtain rod lug attaching member 55 to make the necessary adjustments.

Figure 5:
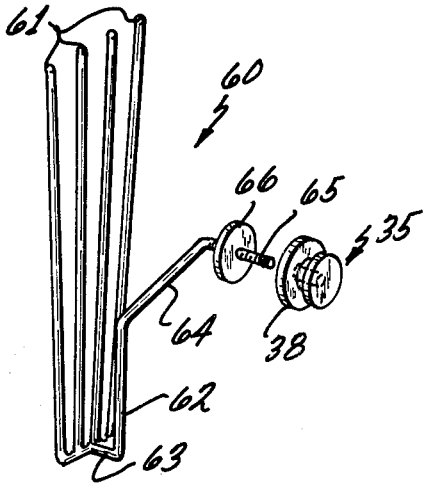
FIG. 5 is a perspective view illustrating a third alternative drapery hanger device.

A third alternative drapery hanging device 60 is illustrated in FIG. 5. It has a plurality of drapery attaching legs 61, a middle body leg 62, and they are secured or connected to each other at their bottoms by cross member 63. Upper portion 64 is bent inwardly at an acute angle away from the drapery attaching legs. The curtain rod lug attaching member 65 is externally threaded and has a disc 66 spaced inwardly from its free end for receiving a standard cap 35.

What is claimed is:

1. A drapery hanger device comprising:

a generally U-shaped member having a pair of upwardly extending legs connected together at their bottoms by a cross member, one of said legs being a drapery attaching leg and the other leg being a middle body leg:

a curtain rod lug attaching member formed at the top end of said middle body leg: and means on said curtain rod lug attaching member for varying the angle that said drapery attaching leg makes with a horizontal plane when said drapery hanger device is attached to the curtain rod lug of a curtain rod, said means comprising said curtain rod lug attaching member having a disc on it, said disc being spaced inwardly from the free end of said curtain rod lug attaching member, said disc functioning as a shoulder against which one face of a curtain rod lug is captured.

2. A drapery hanger device as recited in claim 1 wherein said means for varying the angle that said drapery attaching leg makes with a horizontal plane further comprises:

a cap having a bore hole along its length, one surface of said cap functioning as a shoulder against which the opposite face of the curtain rod lug is captured.

3. A drapery hanger device as recited in claim 2 wherein said curtain rod lug attaching member is externally threaded from said disc to its free end and the bore of said cap is also threaded so that it may be screwed on the free end of said curtain rod lug attaching member.

4. A drapery hanger device as recited in claim 2 wherein said shoulder on said cap is formed in the shape of a disc.

5. A drapery hanger device as recited in claim 1 wherein said drapery attaching legs is longer than said middle body leg.

6. A drapery hanger device as recited in claim 1 wherein said drapery attaching leg is detachable from said cross member.

7. A drapery hanger device as recited in claim 6 wherein said drapery attaching leg has a plurality of spring fingers adjacent its bottom for attachment to said cross member.

8. A drapery hanger device as recited in claim 1 wherein the upper portion of said middle body leg is bent inwardly at an acute angle away from said drapery attaching leg.

9. A drapery hanger device as recited in claim 1 wherein said generally U-shaped member has a plurality of drapery attaching legs extending upwardly from said cross member.

* * * * *